United States Patent [19]

Krauss

[11] 4,273,451

[45] Jun. 16, 1981

[54] MIXING CHAMBER SILO WITH IMPROVED MIXING

[75] Inventor: Werner Krauss, Hamburg, Fed. Rep. of Germany

[73] Assignee: Claudius Peters AG, Hamburg, Fed. Rep. of Germany

[21] Appl. No.: 51,169

[22] Filed: Jun. 22, 1979

[30] Foreign Application Priority Data

Jun. 26, 1978 [DE] Fed. Rep. of Germany ..... 2827991

[51] Int. Cl.[3] ..... B01F 13/02

[52] U.S. Cl. ..... 366/101; 99/646 S; 366/182; 366/341

[58] Field of Search ..... 366/341, 101, 182, 150, 366/107; 99/646 S

[56] References Cited

U.S. PATENT DOCUMENTS

| | | | |
|---|---|---|---|
| 3,862,707 | 1/1975 | Reiter | 366/101 |
| 4,184,774 | 1/1980 | Krauss | 366/101 |

FOREIGN PATENT DOCUMENTS

| | | | |
|---|---|---|---|
| 2640714 | 3/1978 | Fed. Rep. of Germany | 366/101 |
| 2657597 | 6/1978 | Fed. Rep. of Germany | 366/101 |
| 2724928 | 12/1978 | Fed. Rep. of Germany | 366/101 |

*Primary Examiner*—Edward J. McCarthy
*Attorney, Agent, or Firm*—Otto John Munz

[57] ABSTRACT

A mixing silo for pulverulent material has a main silo chamber with a floor and a mixing chamber with a conical roof substantially centrally arranged on the floor of the silo chamber. A discharge for the material leads from the mixing chamber through the wall of the silo, and inlet openings for the material lead from the bottom of the silo chamber through the bottom of the wall of the mixing chamber. Additionally inlet openings for the material lead from different elevations within the silo chamber through the conical roof of the mixing chamber, for supply of material into the mixing chamber from different elevations in the silo chamber, thus achieving increased mixing and improved flow of the material.

6 Claims, 4 Drawing Figures

MIXING CHAMBER SILO WITH IMPROVED MIXING

BACKGROUND OF THE INVENTION

This invention relates to a mixing chamber silo to which material is supplied from above, and wherein a mixing chamber is arranged substantially centrally on the floor of the main silo chamber. Material is supplied from the silo chamber to the mixing chamber through a plurality of inlet openings around the bottom of the mixing chamber, and a discharge from the mixing chamber leads through the wall of the silo.

Mixing chamber silos are known (DE PA 15 07 888), in which the mixing effect is based on the preliminary mixing in the main silo chamber in addition to the homogenization of relatively small quantities of loose material in the mixing chamber. This preliminary mixing is primarily effected in that when individual floor areas of the silo floor are aerated for the purpose of removing loose material from these areas, a movement of material takes place in a downward direction into the lateral material inlet orifices or openings of the mixing chamber. This movement is not only connected with a shifting of the material layers located above this area relative to adjacent material layers, but also with a commingling of the loose material within the lowering column of material and in the area of the edges as well of the funnel (funnel effect) which forms at the surface of the material. In the language of a person skilled in this art, this type of movement of material is termed spout formation. The mixing effect of a spout is limited to its horizontal expansion, and this expansion, in turn, is determined from below by the expansion of the effectively aerated floor area of the main silo. Above, the spout formation increases according to the slope of the material resulting from the slippage.

The radial expansion of the spout should, is possible, correspond to the total radial extent of the silo. However, the possible radial extent of this type of spout if limited, since the conveying effect of the pneumatic conveyor leading to the mixing chamber decreases as the distance from the mixing chamber increases.

PRIOR ART

In a known mixing apparatus having a mixing chamber (DE PA 21 21 616) the silo floor is divided into two or more annular zones which are arranged at different heights increasing toward the center of the silo. The pneumatic conveyors of each annular zone open directly into the mixing chamber, or by means of pneumatic conveying sections which pass through the wall of the mixing chamber and are covered by the further inwardly arranged annular zones. By means of this arrangement, a pneumatic conveyance can take place from each annular zone directly into the mixing chamber while a spout forms, without the radially inward flow areas negatively influencing the effectiveness of the spout-forming pneumatic conveyance in the areas lying further outward radially. For this type of silo construction, however, with a so-called terrace arrangement, there are significant additional costs for the structural body and for the thus increased aeration surfaces on the terraces. Energy consumption is also increased as a result of the enlarged aerated surfaces.

In a further known mixing silo (DE-0S 25 00 784), the mixing is performed by means of gravity via a saddle-shaped silo insert having a plurality of discharge orifices on the saddle, which discharge orifices are connected with a further silo located beneath the first-named silo by means of vertical tubes. The vertical tubes have sliding members and end above baffle distributors within the lower silo. Aside from the fact that this is not a mixing silo of the pneumatic mixing silo type, this silo has an expensive double-level construction and does not use the space beneath the saddle of the upper silo as a mixing chamber.

SUMMARY OF THE INVENTION

The basic objective of the invention is to create an apparatus of the cited type, in which a very effective mixing spout formation is achieved in a simple and economical manner, which is accomplished on an alternating ring basis line and includes the higher elevations within the main silo chamber, so that a larger portion of the main silo chamber is activated and finally, the overall degree of the mixing effect of the mixing chamber silo is increased.

This objective is achieved according to the invention in a mixing chamber silo of the above-described type in that additional material inlet openings are provided in the conically shaped area of the mixing chamber wall in the form of aeratable inlet boxes in the openings and which narrow towards the interior of the mixing chamber.

In this manner, no particular changes need be made in the structural body itself in a basic conception of a mixing chamber silo, but rather with the aid of small corrections, the degree of effectiveness of the mixing silo can be improved. The mass exchange in the main silo chamber is intensified by the material inlets to the mixing chamber arranged at different elevations of the conical mixing chamber wall. This arrangement is particularly advantageous when a loose material is involved which possesses a very limited air content capacity and therefore has negative flow characteristics in the frictional resistance behavior.

According to a further characteristic of the invention, the adjustable aeration of the inlet boxes is accomplished with the aid of the blowers for the floor aeration of the mixing chamber. The aeration thus serves as a regulating value for the quantity of loose material to be fed into the mixing chamber. This aeration can take place either continuously or discontinuously, so that the feed through the inlet boxes located in the conical casing occurs continuously or selectively.

According to the invention, it is also advantageous if a regulation of the aeration of the inlet boxes is provided in dependence on the degree to which the mixing chamber is filled. The fill level in the mixing chamber is measured in a known manner by level indicators such as described in DE-OS 25 08 981. Since the basic feed from the floor of the main silo chamber through the lower material inlet orifices of the mixing chamber remains independent of the material feed through the aeratable inlet boxes in the mixing chamber casing in the mixing chamber silo according to the invention, this method of operation proves to be an additional advantage in a continuously operating mixing apparatus.

A slide control for the individual inlet boxes in the area of the mixing chamber casing is not provided, because in the present case the feed is into a mixing chamber, whereby even when there is an internal overfill condition there is pressure compensation and to this extent operation disruptions are excluded when the flow of loose material is stopped.

According to the invention, the dosage shutter in the inlet box has a passage cross section in the form of a triangle with an upwardly directed point. This type of shutter or gate has also been proven as a reliable dosage method for aerated loose material in batch rolling, for example.

DETAILED DESCRIPTION OF THE PREFERRED EMBODIMENTS

Figure 1:
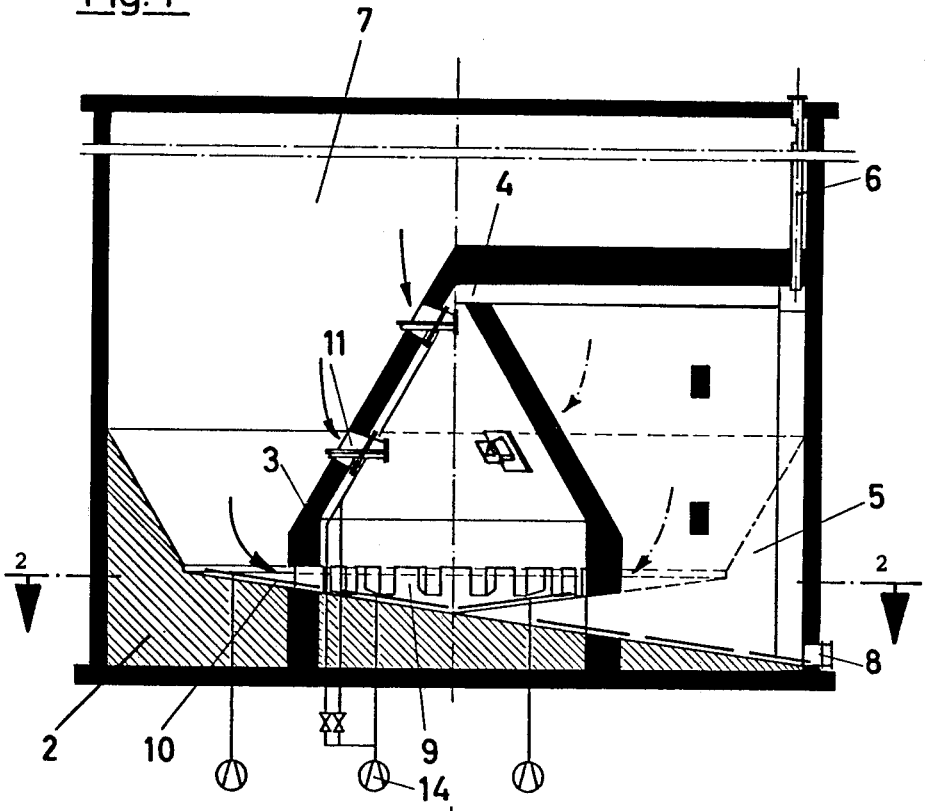
FIG. 1 is a central vertical section through a mixing silo embodying the invention, and is taken along line 1—1 in FIG. 2.
Figure 2:
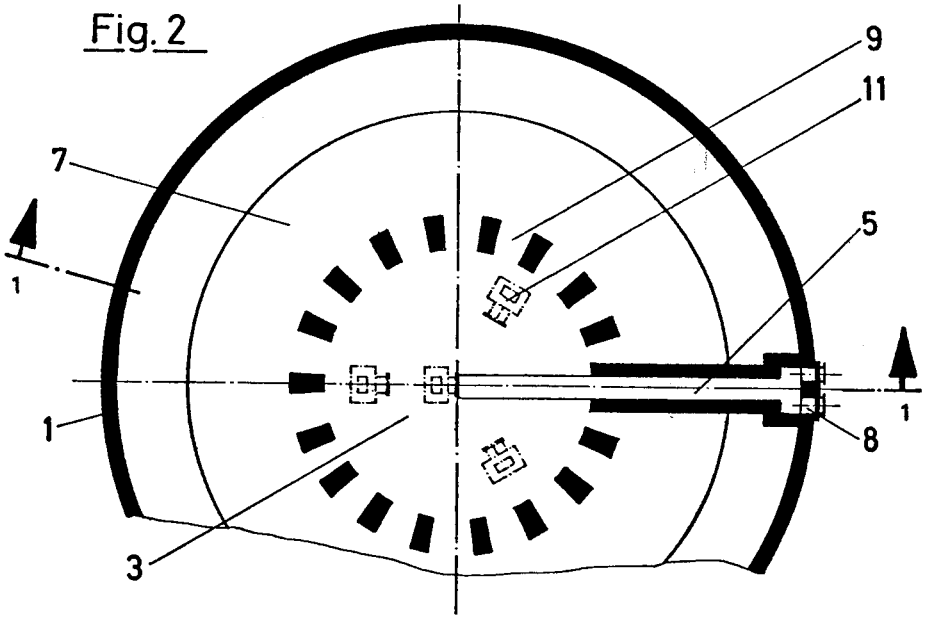
FIG. 2 is a sectional view along line 2—2 in FIG. 1, showing the floor of the silo and the mixing chamber.

Referring to the drawings, wherein like reference numerals indicate like parts throughout the several views, the walls and top of the silo 1 are shown only schematically, and not shown are the illustrations of the loose material feed devices and the filter provided on the top or roof of the silo. Reference should be made in this respect, for example, to DE-PA 21 21 616.

The floor 2 of the silo runs at a slight angle toward the center, where the mixing chamber 3 is arranged, and the mixing chamber includes cylindrical walls in the lower region and at the top runs conically to ventilator 4. A discharge chamber 5 is joined with the mixing chamber, extending to the wall of the silo and having clearance space corresponding to that of the mixing chamber. The discharge chamber has a ventilation pipe 6 which leads up the wall of the main silo chamber 7 to the top of the silo. The side discharge orifices of the discharge chamber are indicated at 8.

The cylindrical portion of the mixing chamber has material inlet orifices 9 about its periphery, which open into the aeration units 10. Additional material inlet orifices in the form of aeratable inlet boxes 11 are located at different elevation in the conical mixing chamber wall or roof. These inlet boxes are mounted from the inside of the mixing chamber and are connected with the wall of the mixing chamber by means of flanges. Each inlet box has an aeratable floor 12.

Figure 3:
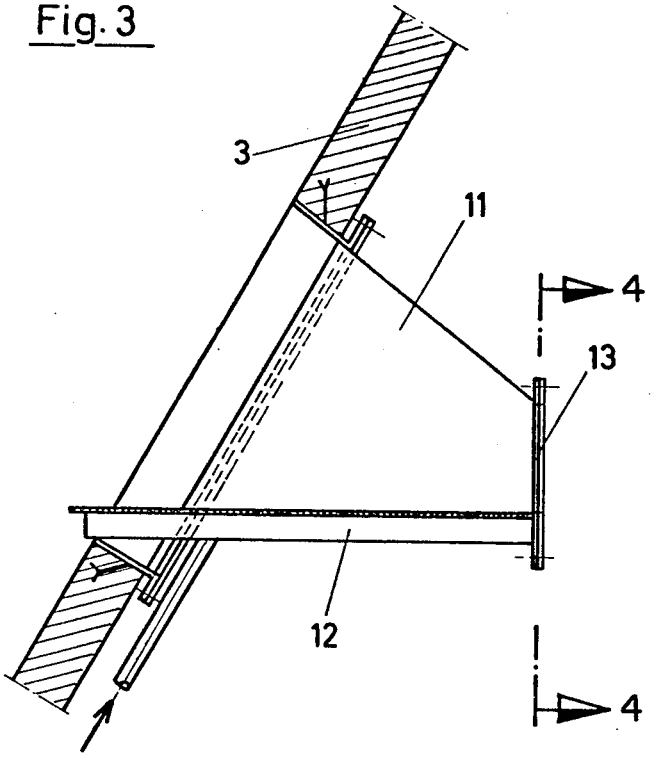
FIG. 3 is an enlarged vertical section of the mixing chamber wall, showing an inlet box to the mixing chamber.
Figure 4:
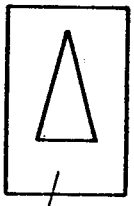
FIG. 4 is a vertical section along line 4—4 in FIG. 3, showing the dosage shutter of the invention.

A dosing shutter 13 can be seen in FIGS. 3 and 4, which has a dosage gate in the form of a triangle having an upwardly directed point. The aeration of the inlet boxes is accomplished by means of blowers 14. A continuous or discontinuous regulation of the aeration of the inlet boxes can be accomplished with a known means of regulation. The method of operation is determined by a fill level indicator (not shown), which is located inside the mixing chamber.

What is claimed is:

1. A mixing chamber silo having a main silo chamber to which the material can be fed from above, and having a floor and a silo discharge and a pneumatic mixing chamber connected with the silo discharge and arranged on the floor of the main silo chamber, the mixing chamber having a lower wall portion and a conical upper wall forming a roof portion, material inlet orifices in the lower wall portion, and additional material inlet orifices disposed in the conical upper wall or roof portion of the mixing chamber, communicating with the silo interior to receive additional material from the silo at different levels therein to facilitate spout formation and mixing of material.

2. A mixing chamber silo as claimed in claim 1, wherein the additional material inlet orifices include aeratable inlet boxes provided with dosing shutters, said inlet boxes narrowing in cross section toward the interior of the mixing chamber.

3. A mixing chamber silo as claimed in claim 2, wherein the amount of aeration of the inlet boxes is adjustable and is accomplished with the aid of blowers for aeration of the floor of the mixing chamber.

4. A mixing chamber silo as claimed in claim 3, wherein a regulation of the aeration of the inlet boxes is provided in dependence on the fill level in the mixing chamber.

5. A mixing chamber silo as claimed in claim 2, wherein the dosing shutter in the inlet box has a passage cross section in the form of a triangle with an upwardly directed point.

6. A mixing chamber silo as claimed in claim 1, wherein:

the additional material inlet orifices in the conical upper wall of the mixing chamber include a plurality of orifices at different levels in the conical upper wall, spaced at different radial distances relative to a vertical center of the silo thereby enhancing mixing of material in the silo.

* * * * *